US005433445A

United States Patent [19]

Melancon

[11] Patent Number: 5,433,445

[45] Date of Patent: Jul. 18, 1995

[54] GOLF SWING TRAINING DEVICE

[76] Inventor: Clyde J. Melancon, P.O. Box 80891, Lafayette, La. 70598

[21] Appl. No.: 65,902

[22] Filed: May 25, 1993

[51] Int. Cl.[6] ..... A63B 69/36

[52] U.S. Cl. ..... 273/186.1; 273/191 R

[58] Field of Search ..... 273/186.1, 191 R, 187 R, 273/191 A, 192, 191 B, 178 R

[56] References Cited

U.S. PATENT DOCUMENTS

| | | | |
|---|---|---|---|
| 1,944,942 | 1/1934 | MacDonald | 273/191 A |
| 3,339,927 | 9/1967 | Nunn | 273/191 A |
| 4,071,251 | 1/1978 | Beckish | 273/191 A |
| 4,852,881 | 8/1989 | Bellagamba et al. | 273/191 A |
| 4,927,152 | 5/1990 | Graham | 273/186 |
| 4,928,975 | 5/1990 | Skelley et al. | 273/192 |
| 4,993,716 | 2/1991 | Waller | 273/188 R |
| 5,050,874 | 9/1991 | Fitch | 273/191 R |

FOREIGN PATENT DOCUMENTS

| | | | |
|---|---|---|---|
| 4146775 | 5/1992 | Japan | 273/191 R |

*Primary Examiner*—Mark S. Graham
*Attorney, Agent, or Firm*—Robert Montgomery

[57] ABSTRACT

A passive golf swing training apparatus used in teaching a golfer the proper fore and aft alignment of the golfer's club in conjunction with a pair of adjustable guide rails that can be set to conform with the particular lie of a golf club. The apparatus provides guidance for the club during the first half of the back stroke from the setup position to the horizonal position. A trigger means, located at the horizonal position, is tripped by the shaft of the golf club, allowing the apparatus to collapse, thereby removing the apparatus as an obstruction on the down stroke.

20 Claims, 8 Drawing Sheets

GOLF SWING TRAINING DEVICE

BACKGROUND OF THE INVENTION

1. FIELD OF THE INVENTION

The present invention relates to the sport of golf and more particularly to golf training aids that provide guidance during practice in a manner that will improve the golfer's ability to strike a golf ball effectively. The need for such guidance has been recognized almost since the game of golf was invented. Over the generations, many instructional devices have been offered to the learning golfer. Such devices include oral or written information, tips, demonstrations and general advice. Elaborate devices have been constructed to restrict the golfer's movement of his limbs, torso or both in a predetermined and supposedly effective manner or, alternatively, to prevent his moving where movement was seen to be detrimental to a successful swing. Such devices are intended to demonstrate the correct mechanics of a swing, and the golfer is expected to become acclimated to the new habits for use on the course. However, since the golfer cannot actually play encumbered by a training device, any training method must train the golfer in a manner that does not make him actually reliant on the device while on the course.

2. GENERAL BACKGROUND

It is well known that the golfer must address the ball properly using the proper grip and stance. It is also essential that the club be in proper alignment throughout the swing. To teach the golfer to maintain proper alignment, various devices have been employed utilizing large cumbersome apparatus. Most such devices have complete or substantially complete arcuate members which extend from point of impact of the golf ball completely around the golfer in an attempt to control the entire swing.

Some golf professionals are now advocating that the first move into the back swing is critical and should be practiced repeatedly using a combination of hands, arms, and body moving together to the point where the shaft is horizontal and parallel to the ground. The golfer must learn to address the ball in a manner that allows the club to assume its normal lie and maintain an accurate fore and aft alignment conforming to the golfer's center of gravity. To perfect the alignment of the club, the golfer must insure that the club face is moved neither away from nor towards the body. In addition, the golfer must learn to achieve a movement whereby the club shaft at the horizonal is parallel to the target with the club head pointed vertical. It becomes evident the hands and club must work independently of the body. Once the club reaches the horizonal position, the golfer's body-build plays a significant part in the remainder of the swing.

Therefore, one must master the set up, lie, shaft alignment and the critical wrist action necessary to produce a proper back swing. It is also essential that such training aids should be capable of not only training golfers to achieve the stance and proper take off on the back swing but also not hinder him on the down stroke.

The closest prior art found which attempted to provide a back swing guide that is both lightweight, and portable was U.S. Pat. No. 4,927,152 issued to Graham. However, the Graham training guide fails to provide a means for controlling the club's lie or the fore and aft angle of the club's shaft in relation to the ball. Furthermore, no means was provided in the Graham patent for removing the apparatus from the path of the golf club on the down stroke.

SUMMARY OF THE PRESENT INVENTION

The present invention describes a portable and lightweight golf swing training aid having an inclinable frame supporting a pair of parallel rails defining the proper path and lie of a golf club during the back-swing. The apparatus is held securely to the ground and is collapsible by the actuation of a triggering device struck by the golf club shaft at the horizonal position.

The apparatus addresses the problems associated with proper stance when addressing the ball and those affected by improper club alinement between point of contact with the ball and the horizonal position of the back swing.

Utilizing a twin rail concept, the instant invention allows the golfer to adjust the angle of the apparatus in a manner coinciding with the proper lie of any golf club. Therefore, when the club shaft is in contact with both rails and coincides with the club's proper lie, the golfer then addresses the ball. The golfer then corrects the shaft's fore or aft positioning, utilizing the alignment marks on the rails. By maintaining contact with the twin rails during the back-swing the golfer receives feedback as to whether or not the hands, arms and shoulder are moving correctly for this particular club.

When the golfer becomes comfortable with the back-swing achieved by maintaining contact with the apparatus' twin rails, he may then practice the down stroke by simply allowing the club to trip the trigger mechanism located at the horizonal position. This allows the apparatus to collapse into a flattened position, thereby providing a clear path to the ball. To resume use of the practice aid, the golfer simply lifts the apparatus back into its previously set position and resumes practicing his back-swing.

DETAILED DESCRIPTION OF THE PREFERRED EMBODIMENT

Figure 1:
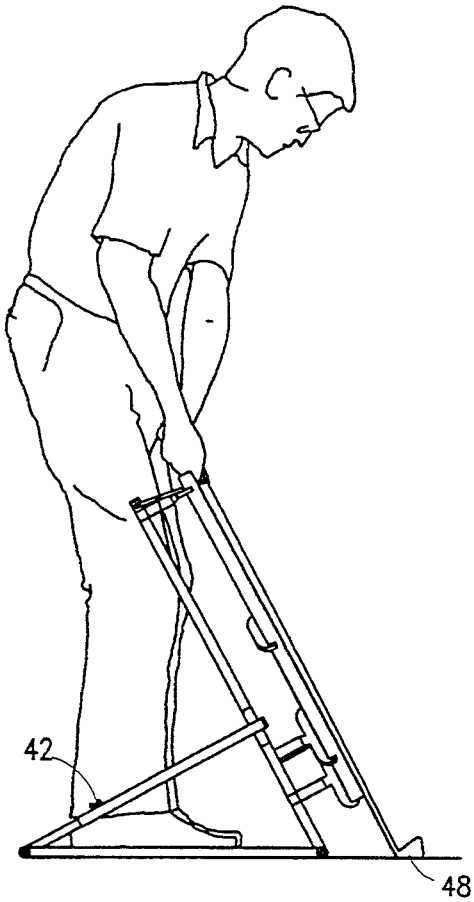
FIG. 1 is a left side view of the golf club swing guide in the inclined position with the golfer adjusting the apparatus to meet the lie of the club.
Figure 2:
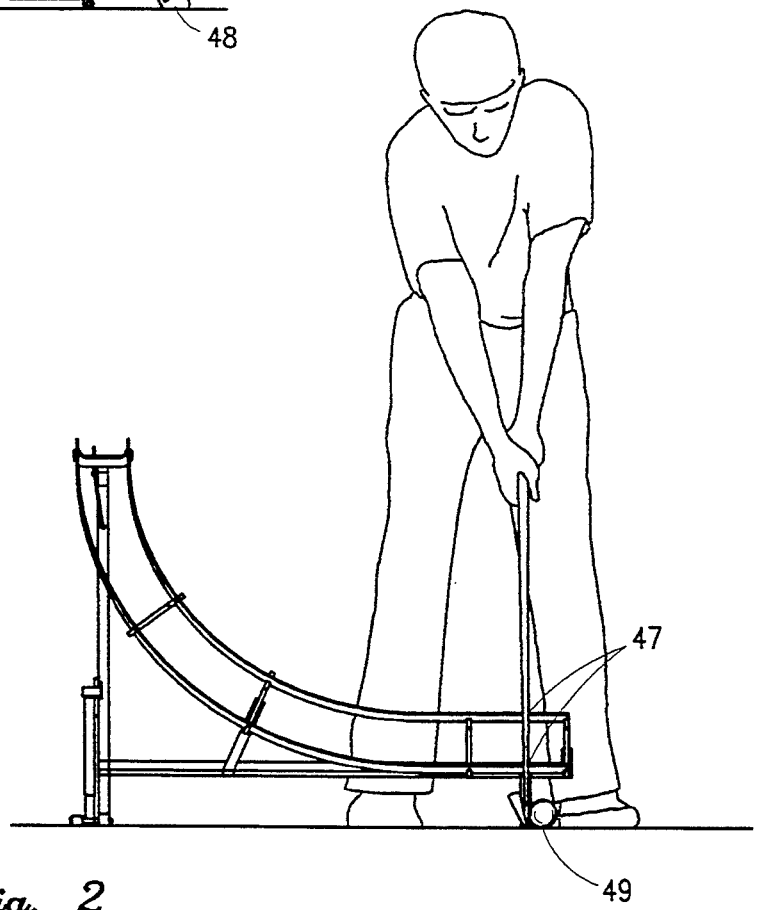
FIG. 2 is a front view of the golf club guide showing the proper fore and aft .alignment of the club shaft when in contact with the twin rails.
Figure 3:
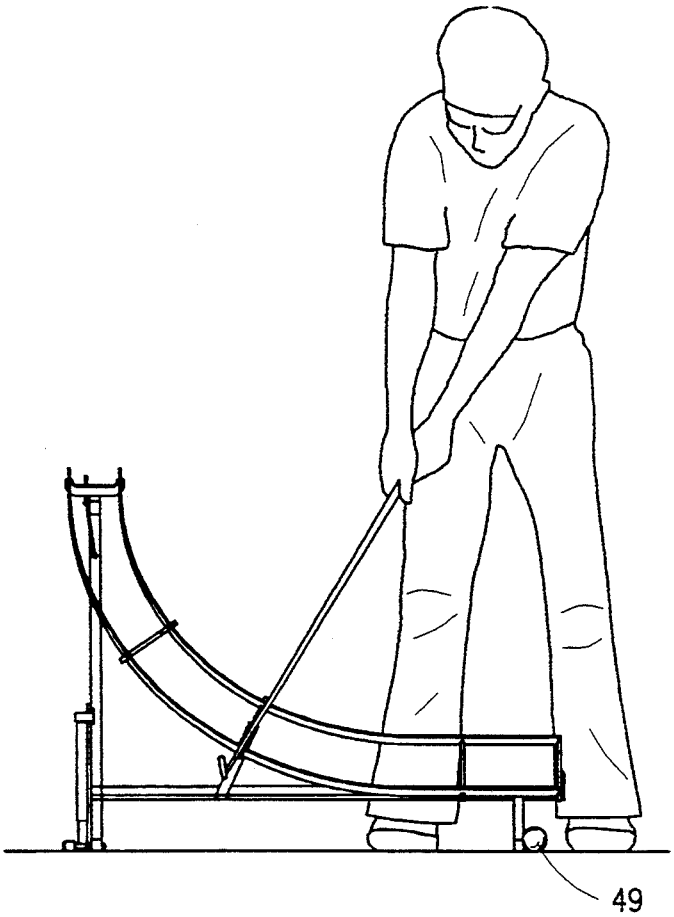
FIG. 3 is a front view of the golf club guide showing the golfer with the club in contact with the apparatus during the back swing at mid-stroke.
Figure 4:
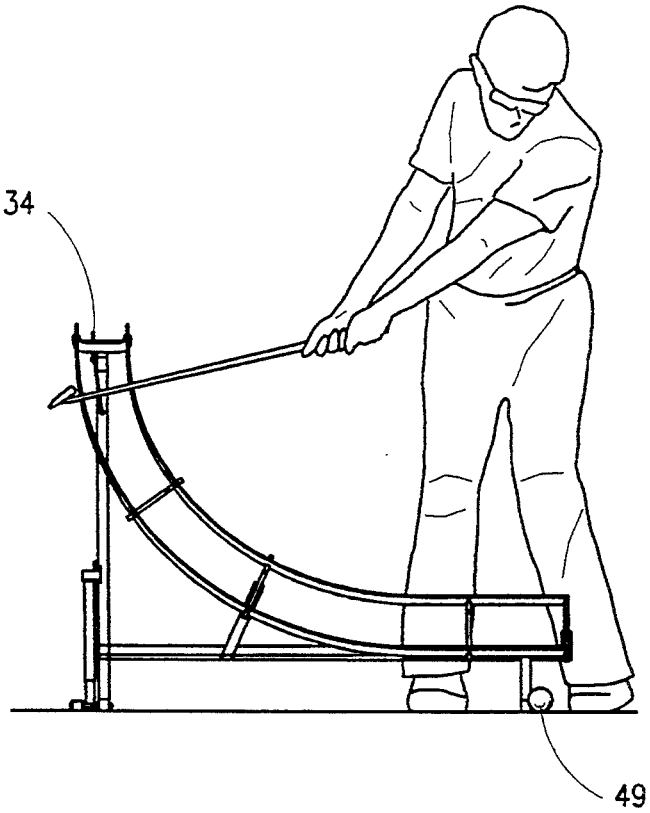
FIG. 4 is a front view of the golf club guide showing the golfer with the club in contact with apparatus during the back swing and approaching the horizonal position and triggering mechanism.
Figure 5:
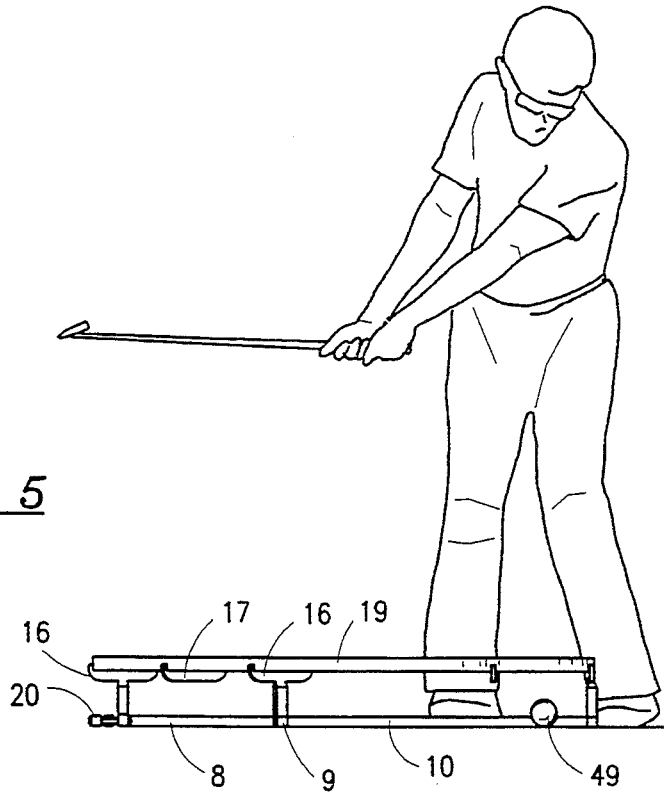
FIG. 5 is a front view of the golf club guide showing the apparatus having been tripped by the golfer when the shaft reached the horizonal position.
Figure 6:
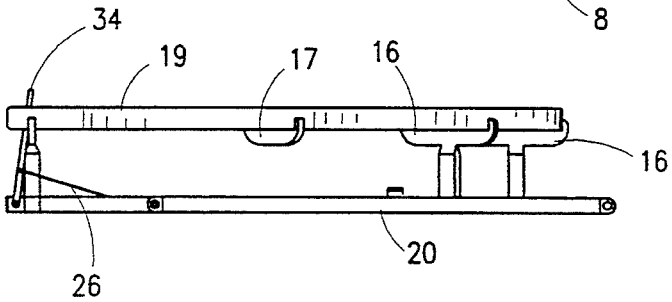
FIG. 6 is a left side view of the golf club guide in the collapsed position.
Figure 7:
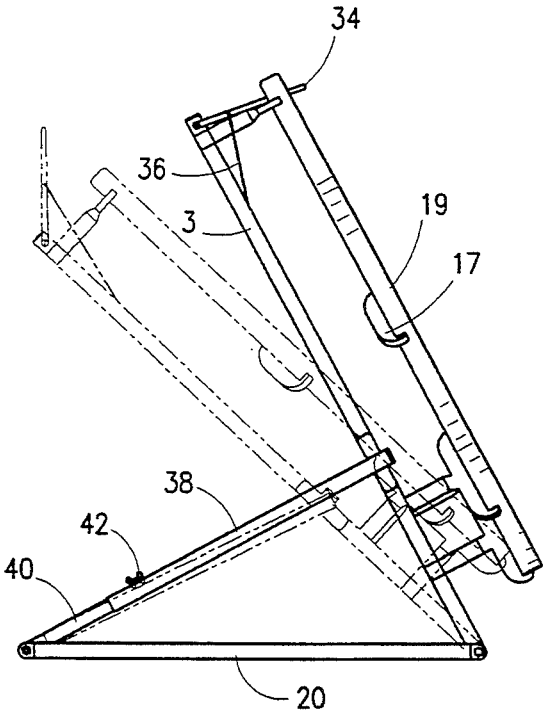
FIG. 7 is a left side view of the golf club guide in the inclined position showing the triggering mechanism.
Figure 8:
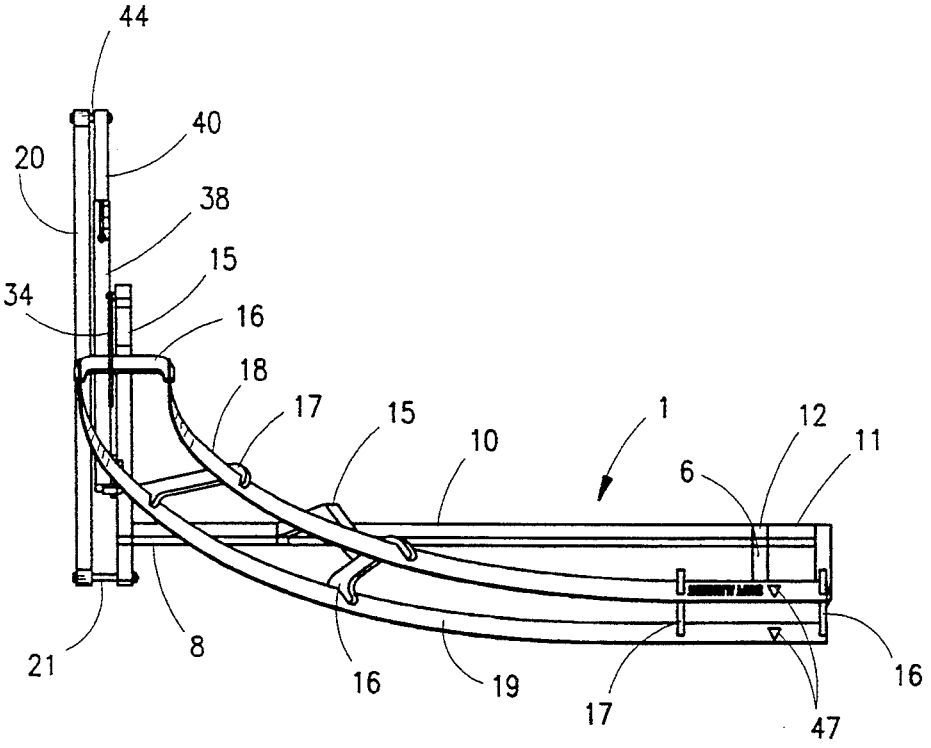
FIG. 8 is a plan view of the golf club guide in the incline position.
Figure 9:
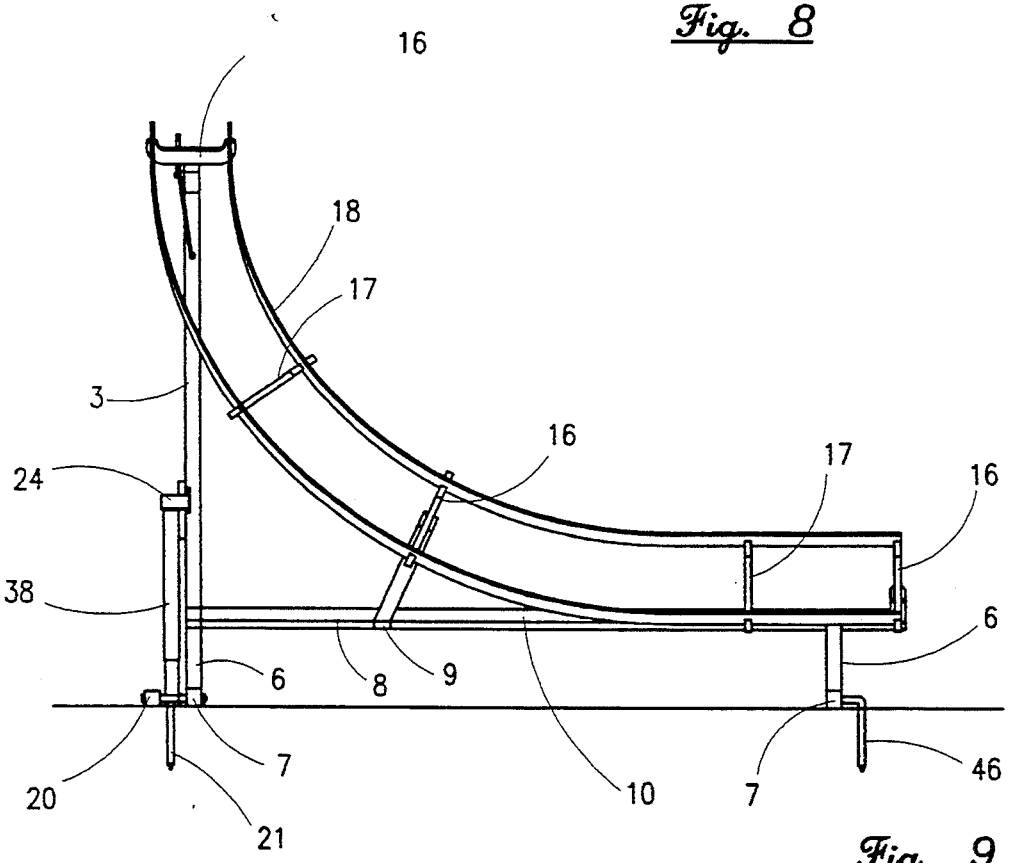
FIG. 9 is a front view of the golf club guide in the inclined position showing the ground anchors at two points.
Figure 10:
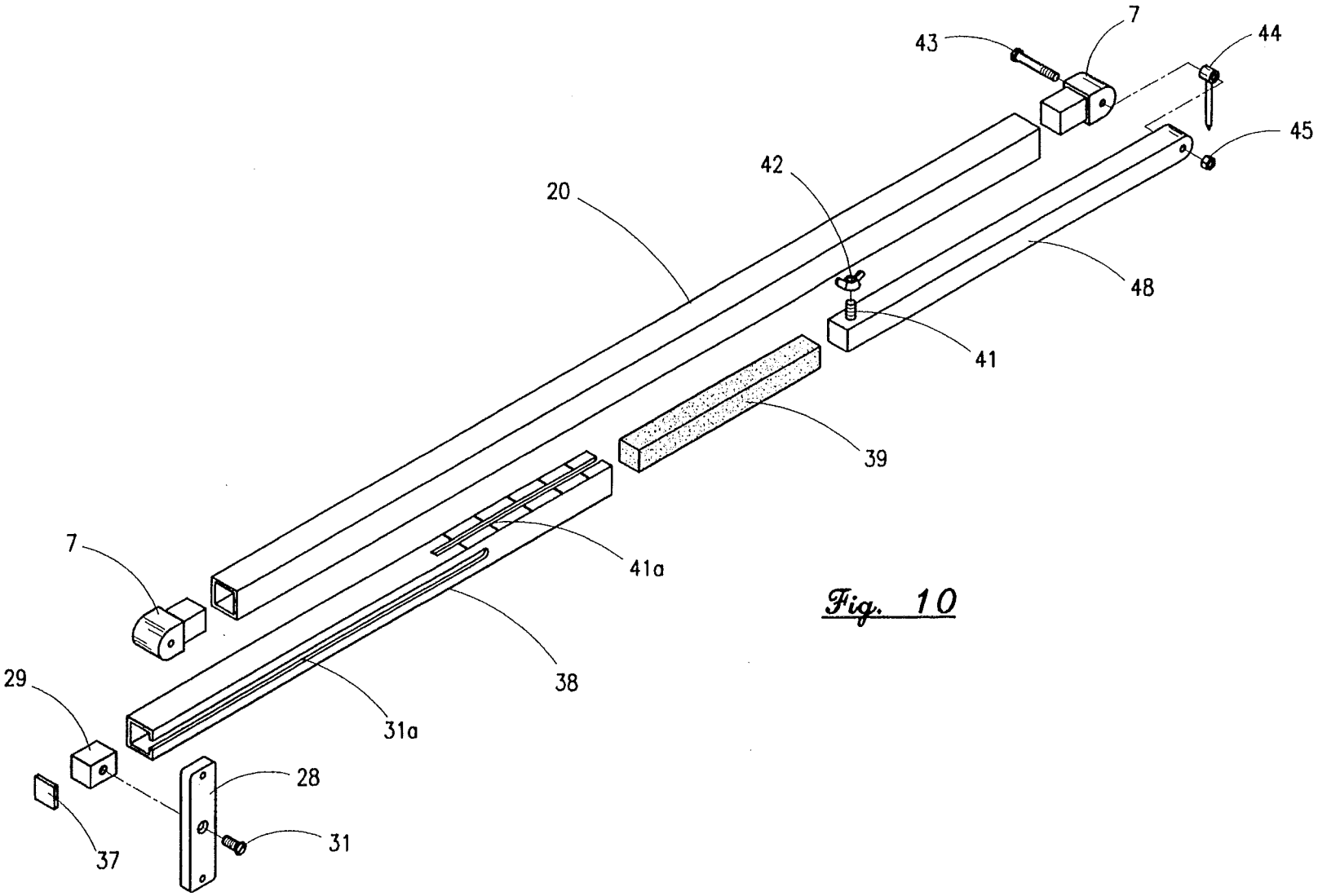
FIG. 10 is an isometric exploded view of the golf club guide's support leg and telescopic bar assembly.
Figure 11:
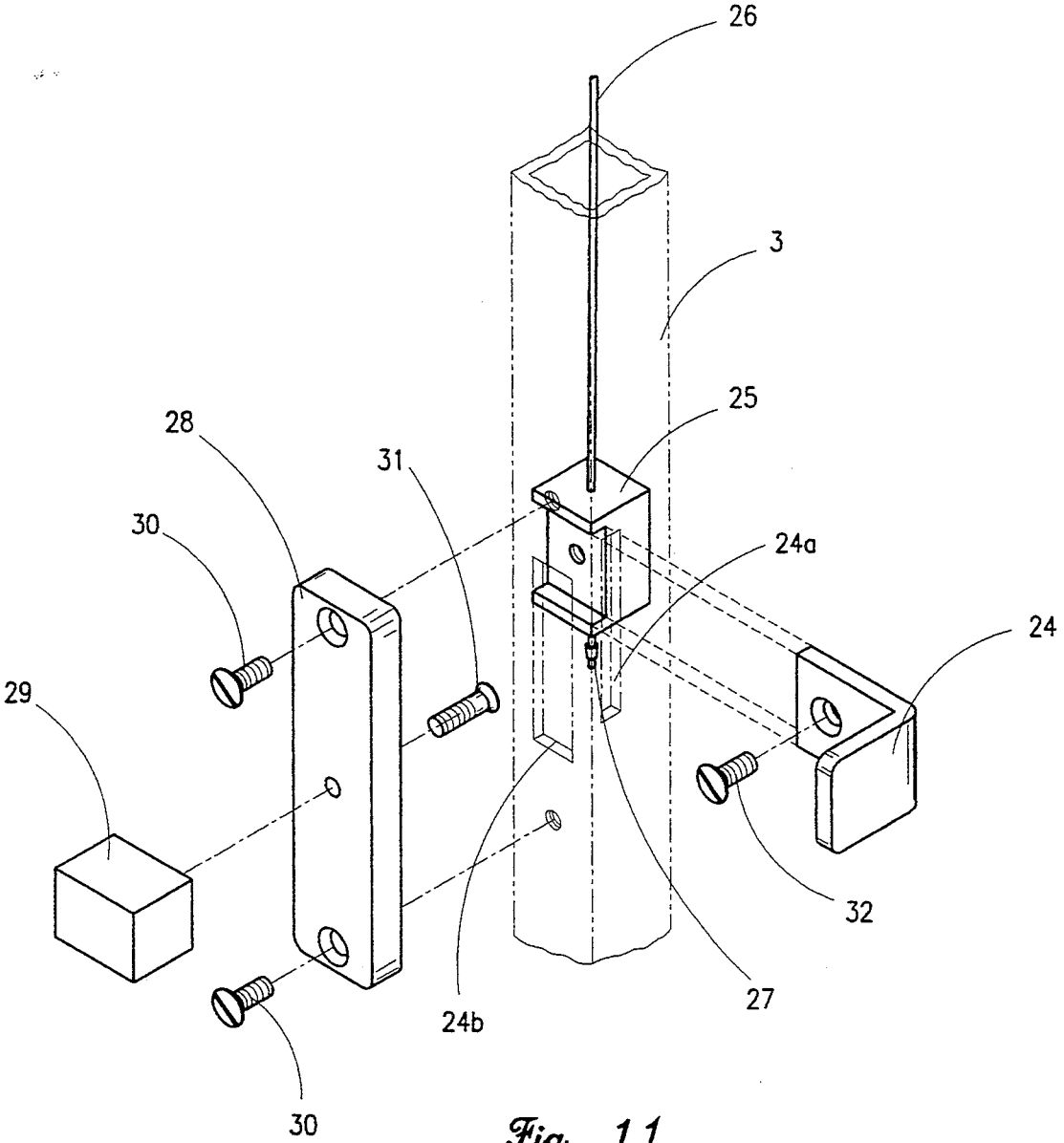
FIG. 11 is an isometric exploded view of the golf club guide's trigger latch mechanism.
Figure 12:
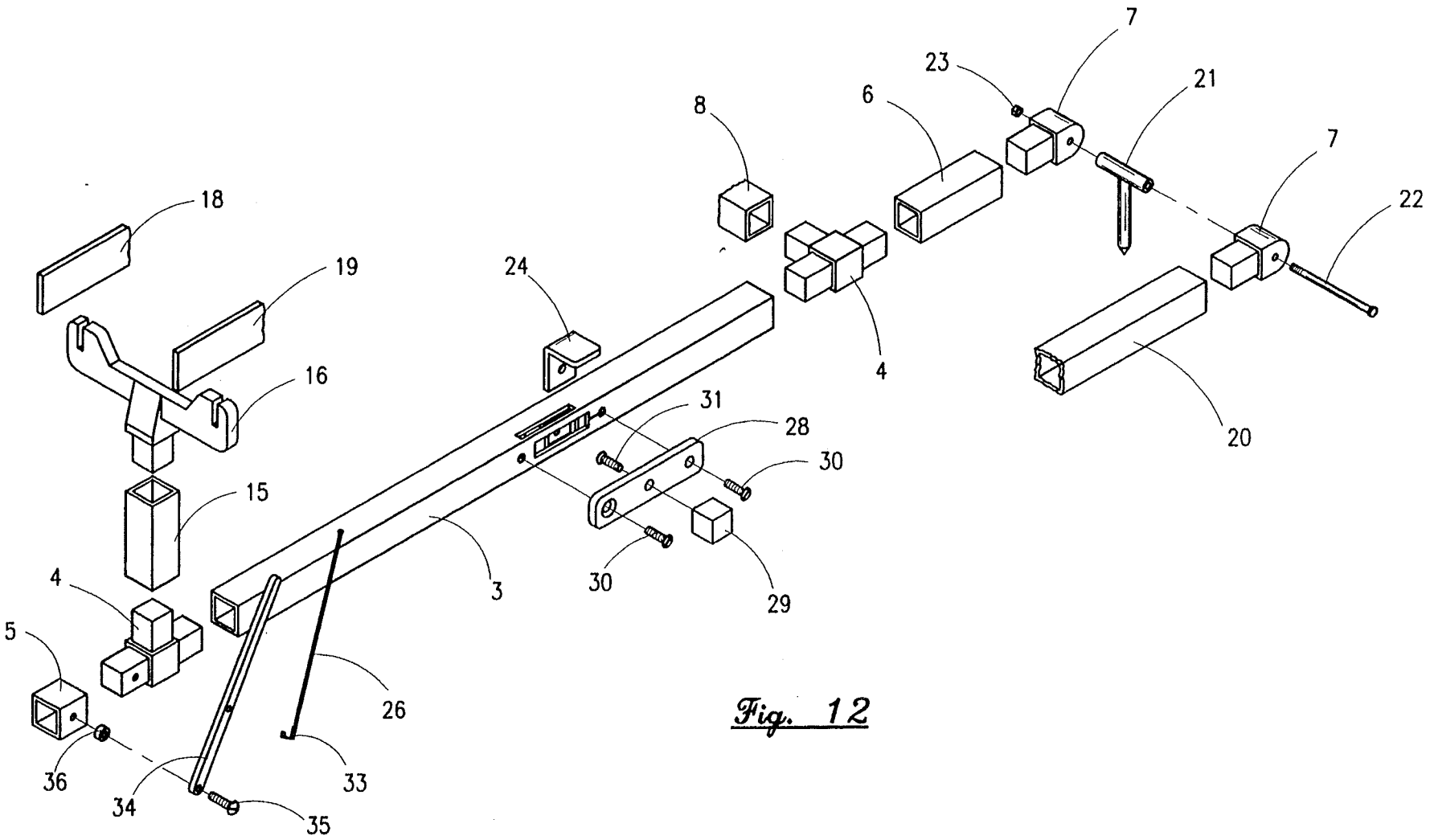
FIG. 12 is an isometric exploded view of the golf club guide's vertical frame member, trigger arm, and rail support member.
Figure 13:
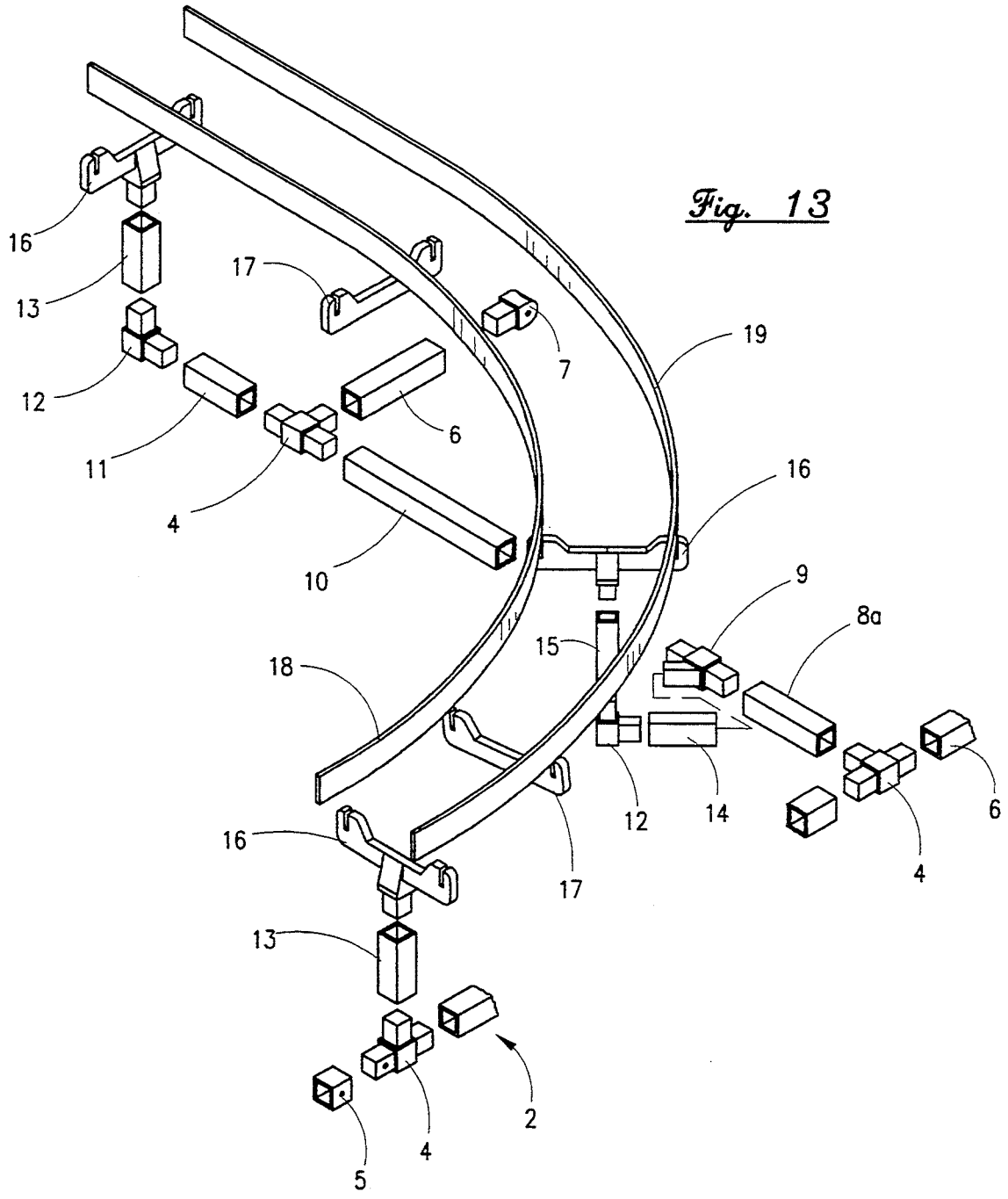
FIG. 13 is an isometric exploded view of the golf club guide's horizonal frame member, support legs, rails, and rail support members.

Looking first at the structure shown in FIG. 12 & 13, we see the instant invention. A golf practice aid assembly 1 comprised of: a vertical column assembly 2 which further comprises a vertical latch tube 3, two tee connectors 4, a trigger tube 5, a support tube 6, a pivot cap 7, and a horizonal assembly 8 which further comprises a first horizonal tube 8*a*, a Y-connector 9, a second horizonal tube 10, a tee connector 4, a third horizonal tube 11 and a ell connector 12. A set of stand off tubes 13,14 extending from the connectors 4 9,& 12 serve to support the rail connectors 16, while rail spacer bars 17 further help to maintain equal spacing of the rails 18,19. Aground support tube 20 capped at each end by a pivot cap 7 is pivotally connected via the front ground stake 21 and its pivot pin and nut 22,23 to the vertical latch tube 3. The vertical latch tube as best seen in FIG. 11 further comprises a latch arm 24, internal latch bar 25, and a latch cable 26. The latch bar is slidable within the latch tube 3 and is retained on the latch cable by a cable retainer 27. The latch arm is inserted through the latch tube 3 slot 24*a* and is retained to the latch bar 25 by the latch arm screw 32 installed through opening 24*b*. A spacer plate is provided for attachment to the latch tube 3 by screws 30. A slide block 29 is secured to the spacer bar 28 by screw 31 for insertion inside of the slide bar 38 and is retained therein by the slide block tube cap 37. Looking now at FIG. 10, we see the slide block tube extender bar 40 and its cushion 39 is telescopicly inserted into the slide block tube 38 and is retained and adjusted within the confines of slot 41a by means of a retainer screw and a wing nut. This adjustment allows the user to set the apparatus to match the proper lie 48 of the club being used. When the trigger arm 34 is tripped by a golf club, the slide block 29 is allowed to move freely within the slide block tube 38 until it contacts the slide block cushion 39. The slide block retainer screw 31 travels freely along the slide block tube slot 31*a*. The slide block bar 40 is cross drilled at its exposed end to allow for its pivotal connection via a ground stake 44 and pivot pin 43 secured to the ground support pivot cap 7 by a nut 45. As seen in FIG. 8 & 9, when the ground stakes 21,44,46 are driven into the ground, the ground bar 20 is secured to the ground, thereby allowing slide bar extender bar 40, and vertical and horizonal support tubes and their pivot caps 6,7, to become pivotal, allowing slide block tube 38 and vertical latch tube 3 to be raised in unison by moving the slide block 29 and screw 32 along slot 31*a* as seen in FIG. 7. To set the latching mechanism, the slide block tube 38 is placed directly behind the latch key 24. Therefore, when the latch key and bar 24, 25 is actuated due to the tripping of trigger arm 34, which pulls latch cable 26 upwards, the latch key is moved from in front of slide block tube 38, allowing the whole assembly 1 to collapse into a compact position adjacent the user's feet as shown in FIG. 5.

To use the apparatus 1, the user stands behind the inner and outer rails 18,19 and to the left of the ground support tube 20 as shown in FIGS. 1–5. The golfer sets the trigger latch in relation to tube 38. He then chooses a golf club and addresses the ball 49 by aligning the club with marks 47 indicated on the leading edge of each of the rails 18,19. The apparatus is then adjusted to the club's particular lie by adjusting the angle of the rails 18,19 by loosening wing nut 42 and lifting the vertical latch tube until both rails touch the club's shaft. Once the proper setting is achieved, a mark can be placed on the slide block tube slot 41*a* to indicate a specific club setting.

It should be clear that a golf swing training apparatus can be provided which provides a swing guide for small and large golfers as well as left-handed and right-handed golfers. The apparatus can be made of molded or formed polymer components without changing the scope of the invention and is designed for inexpensive manufacture and wide distribution. Accordingly, the present invention is not to be construed as limited to the forms shown which are illustrative rather than restrictive.

What is claimed is:

1.

a) a tubular ground support member;

b) a telescopic support member pivotally connected, parallel to and, adjacent said tubular ground support member;

c) an L-shaped frame having at least two support legs, pivotally attached to said ground support member opposite said telescopic support member;

d) a latch key means operative within said L-shaped frame for temporarily engaging said telescopic support member;

e) a trigger means operative within said L-shaped frame for releasing said latch key means; and f) a guide rail means, attached to said L-shaped frame, for passively guiding a golf club through the lower portion of a golfer's back swing.

2. A golf swing training apparatus in accordance with claim 1 wherein each end of said tubular ground support member and at least one of said L-shape frame support legs are pivotally anchored to the ground.

3. A golf swing training apparatus in accordance with claim 2 wherein said telescopic support member positions said L-shaped frame at an angle equal to the particular lie of a golf club and provides a means for triggered collapsibility.

4. A golf swing training apparatus in accordance with claim 3 wherein said latch means further comprises;

a) latch arm;

b) a latch bar located internally in the vertical portion of said L-shaped frame, for receiving said latch arm;

c) a trigger arm pivotally attached to the upper end of the vertical portion of said ell shaped frame; and c) a latch cable attached to said latch bar at one end and connected to said trigger arm at the opposite end.

5. A golf swing training apparatus in accordance with claim 4 wherein said telescopic support member further comprises;

a) a slide block tube;

b) a slide block tube extender bar, internally slidable within said slide block tube;

c) a slide block, located inside said slide block tube, pivotally connected to said vertical portion of said ell shaped frame; and d) a cushion located internally in said slide block tube between said slide block tube extender bar and said slide block.

6. A golf swing training apparatus in accordance with claim 5 wherein said trigger means is actuated by the shaft of a golf club at the horizonal position of the golfer's back stroke.

7. A golf swing training apparatus in accordance with claim 6 wherein said trigger means is attached to said latch bar and said latch arm and thereby when tripped allows said ell shaped frame to collapse.

8. A golf swing training apparatus in accordance with claim 7 wherein said pair of parallel rails form the lower left quadrant of a parabola.

9. A golf swing training apparatus in accordance with claim 8 wherein said guide means is a pair of parallel rails held spacedly apart, having alignment marks indicating the proper fore and aft alignment of the shaft of a golf club at the set up position.

10. A golf swing training apparatus in accordance with claim 9 wherein said guide means is adjustable to match the proper lie of a particular golf club.

11. A golf swing training apparatus in accordance with claim 9 wherein said means serves as a passive guide for the golfer's club shaft during the first half of the back stroke and is automatically removed as an obstruction on the downstroke.

12. A golf back swing training apparatus comprising:

a) a tubular ground support member;

b) a telescopic support member pivotally connected, parallel to and, adjacent said tubular ground support member;

c) an L-shaped frame having vertical and horizonal members, pivotally attached to said ground support member opposite said telescopic support member;

d) at least two ground support legs extending from said horizonal member;

e) a latch key means operative within said L-shaped frame vertical member for temporarily engaging said telescopic support member;

f) a trigger means operative within said L-shaped frame vertical member for releasing said latch key means; and g) a pair of guide rails, supported by said L-shaped frame, for passively guiding a golf club through the lower portion of a golfer's back swing.

13. A golf swing training apparatus in accordance with claim 12 wherein said latch means further comprises;

a) latch arm;

b) a latch bar, slidable within the vertical member of said L-shaped frame, for receiving said latch arm;

c) a trigger arm, pivotally attached to the upper end of the vertical portion of said L-shaped frame; and d) a latch cable, attached to said latch bar at one end and connected to said trigger arm at the opposite end.

14. A golf swing training apparatus in accordance with claim 13 wherein said telescopic support member further comprises;

a) a slide block tube;

b) a slide block tube extender bar, internally slidable within said slide block tube;

c) a slide block, located inside said slide block tube, pivotally connected to said vertical portion of said L-shaped frame; and d) a cushion located internally in said slide block tube between said slide block tube extender bar and said slide block.

15. A golf swing training apparatus in accordance with claim 14 wherein said trigger means is actuated by the shaft of a golf club at the horizonal position of the golfer's back stroke.

16. A golf swing training apparatus in accordance with claim 15 wherein said trigger means is attached to said latch bar and said latch arm and, thereby, when tripped, allows said L-shaped frame to collapse.

17. A golf swing training apparatus in accordance with claim 16 wherein said pair of parallel rails form the lower left quadrant of a parabola.

18. A golf swing training apparatus in accordance with claim 17 wherein said guide means is a pair of parallel rails held spacedly apart, having alignment marks indicating the proper fore and aft alignment of the shaft of a golf club at the set up position.

19. A golf swing training apparatus in accordance with claim 18 wherein said guide means is adjustable to match the proper lie of a particular golf club.

20. A golf swing training apparatus in accordance with claim 19 wherein said means serves as a passive guide for the golfer's club shaft during the first half of the backstroke and is automatically removed as an obstruction on the downstroke.

* * * * *